US005735442A

United States Patent [19]

Emrich

[11] Patent Number: 5,735,442

[45] Date of Patent: Apr. 7, 1998

[54] DEVICE, CLAMPING TOOL AND PROCESS FOR BREAKING AWAY CUTTINGS WHEN CUTTING OUT BLANKS FROM CARDBOARD

[76] Inventor: Dirk Emrich, Graf-Albert-Str. 22, 51709 Müllenbach, Germany

[21] Appl. No.: 537,748

[22] PCT Filed: May 14, 1994

[86] PCT No.: PCT/EP94/01569

§ 371 Date: Nov. 14, 1995

§ 102(e) Date: Nov. 14, 1995

[87] PCT Pub. No.: WO94/26480

PCT Pub. Date: Nov. 24, 1994

[30] Foreign Application Priority Data

May 15, 1993 [DE] Germany ..... 43 16 318.1

[51] Int. Cl.[6] ..... B26F 3/02

[52] U.S. Cl. ..... 225/1; 225/97; 225/103; 493/373

[58] Field of Search ..... 225/1, 93, 97, 225/103; 493/342, 372, 373

[56] References Cited

U.S. PATENT DOCUMENTS

| | | | |
|---|---|---|---|
| 3,206,088 | 9/1965 | Meyer et al. | 225/97 |
| 3,303,979 | 2/1967 | Lang | 225/103 |
| 3,552,615 | 1/1971 | Murray | 225/93 |
| 3,670,791 | 6/1972 | Johnson | 225/93 |
| 4,964,555 | 10/1990 | Hnatuk | 225/93 |
| 5,179,882 | 1/1993 | Takeuchi et al. | 493/342 |
| 5,181,640 | 1/1993 | Vossen et al. | 225/93 |
| 5,353,978 | 10/1994 | Varidel et al. | 225/97 |

*Primary Examiner*—Maurina T. Rachuba
*Attorney, Agent, or Firm*—Banner & Witcoff, Ltd.

[57] ABSTRACT

In a device and a process, as well as a clamping tool for breaking away blank cuttings during the cutting out of cardboard in an automatic cutting press with a breaking away tool comprising breaking away shafts (9), a matrix (11) and a clamping tool for holding the cutting (6) to be broken away through the matrix openings (12) and hanging on a cardboard bridge (13) on the cardboard blank (7), the clamping tool is constructed as a one or multiple-part, flat element (16), which supports flat the matrix (11) and is in elastic operative connection with the breaking away shafts over the cuttings (6) at the time of breaking away. According to a further development of the invention, the flat element (16) is covered with an elastic covering layer (17) and with a multi-part construction the flat element (16) comprises clamping segments cyclically rotatable about its longitudinal axis, so that during rotation openings are freed between the clamping segments for discharging the separated cuttings (16). The proposed device can be used for different blank types and is suitable for reequipping conventional automatic cutting presses.

14 Claims, 2 Drawing Sheets

Figure 1:
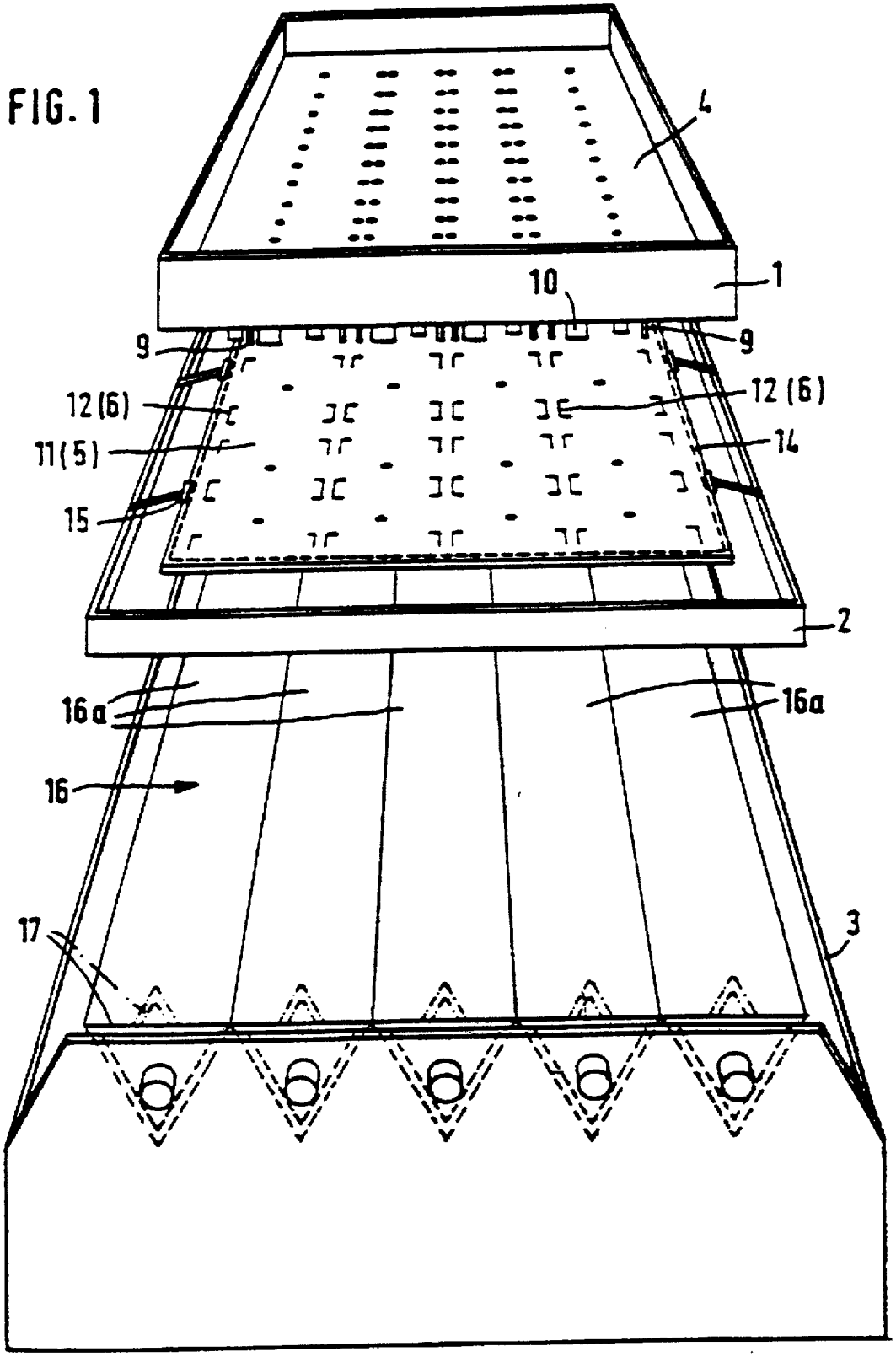
Figure 2:
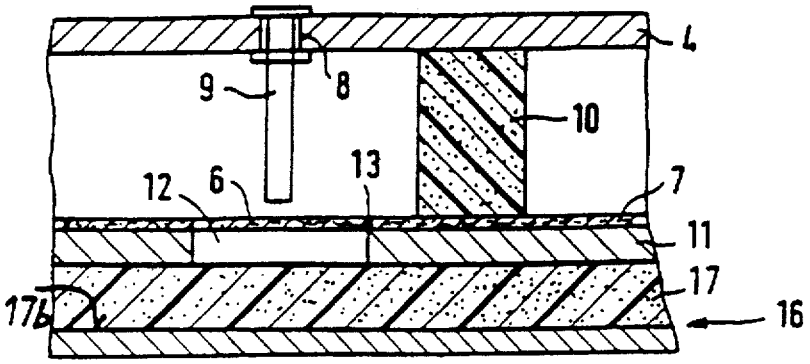

DEVICE, CLAMPING TOOL AND PROCESS FOR BREAKING AWAY CUTTINGS WHEN CUTTING OUT BLANKS FROM CARDBOARD

The invention relates to a device, a clamping tool and a process for breaking away cuttings when cutting out blanks from cardboard in an automatic cutting press, having a matrix, whose openings are slightly larger than the cuttings to be broken away, and with cyclically vertically movable breaking away tools arranged above the matrix, as well as cyclically vertically movable clamping tools below the matrix for gripping and separating the cuttings in conjunction with the breaking away tools.

The breaking away tools can be constituted by breaking away shafts or equivalent punches or the like which can be engaged from above on the cuttings.

DE-U-90 03 329 describes a device of the aforementioned type for breaking away blanks. The clamping tools are abutments, which are arranged in movable or resilient manner within the particular opening. In their inoperative position the abutments engage below and roughly parallel the cuttings which are located in the cardboard sheet. On moving the cuttings through the breaking away tools, particularly the breaking away shafts, the cuttings can be brought into an inclination angle with respect to the cardboard sheet. In the different embodiments the abutments are formed by one or more tongue-like springs, portions of one or more rotary bodies or by elastic noses or bristles.

JP-A-4 201 100 describes a device for breaking away blanks during the cutting out of cardboard in an automatic cutting press. The device has a flat support plate, which has on its top surface a sponge-like, flat, elastic layer. The device operates cyclically. The flat, elastic layer is movably arranged on the support plate in the vertical direction below a matrix.

In known high speed automatic cutting presses for cutting or punching cardboard sheets, e.g. for producing cardboard boxes, the cuttings left behind after the cutting process between the cardboard blanks are held on small cardboard bridges, so that the cuttings do not drop onto the cutting plate and can consequently not impede the following cutting or punching process. The cut cardboard sheet, which is still adequately adhering to the cardboard bridges, then passes by means of gripping devices into the breaking away station of the automatic cutting press, in which the blanks from the cardboard sheet are cut out and drop into a waste container. During the breaking away process the cut cardboard sheet is so positioned on a matrix, that its openings are congruent with the cardboard sheet cuttings. The blanks are now gripped or clamped by a breaking away or clamping tool moved up from above or below in the form of breaking away shafts and facing the same, usually resiliently mounted clamping pins and during the joint downward movement of the two tools are pressed through the matrix opening and consequently broken out of the cardboard sheet. Whereas the tool with the clamping pins moves further downwards to ensure an effortless removal of the broken away blank cuttings, the breaking away shafts move immediately upwards again so as to permit the supply of the following cardboard sheet.

There are admittedly breaking away station of the automatic cutting press, in which the blanks from the cardboard sheet are cut out and drop into a waste container. During the breaking away process the cut cardboard sheet is so positioned on a matrix, that its openings are congruent with the cardboard sheet cuttings. The blanks are now gripped or damped by a breaking away or clamping tool moved up from above or below in the form of breaking away shafts and facing the same, usually resiliently mounted clamping pins and during the joint downward movement of the two tools are pressed through the matrix opening and consequently broken out of the cardboard sheet. Whereas the tool with the clamping pins moves further downwards to ensure an effortless removal of the broken away blank cuttings, the breaking away shafts move immediately upwards again so as to permit the supply of the following cardboard sheet.

There are admittedly breaking away devices in which there are no clamping or devices in which there are no clamping or lower pins. However, on breaking away the blank cuttings without a corresponding guidance or clamping from below, problems easily occur due to cuttings which have become stuck, because they are not completely broken away.

The upper and lower breaking away or clamping tools, like the matrix, are advantageously fixed in a slide-in frame, which are inserted in slide-in units in the breaking away station.

The setting of the breaking away shafts and the clamping pins normally takes place by hand exactly in accordance with the shape and arrangement of the openings of the matrix or the blank cuttings and for each cutting there must generally be individual clamping pins precisely facing a larger number of breaking away shafts. Whereas the arrangement of the breaking away shafts is normally programmable in accordance with the shape of the blank cuttings for the different blank types and can take place by inserting in automatically produced bores of a receiving plate, the clamping pins are always fixed manually on rails displaceable in a frame, between which the cuttings can drop into the waste container, so as to be precisely aligned with the breaking away shafts.

The manual, positionally precise setting of the clamping pins requires much skill and experience and is also very time-consuming, particularly under the standpoint that for each blank change the clamping pins must be reset. However, the storage of numerous frames with clamping pins already set in accordance with the particular blank type consumes much space and in particular the expensive frames make this cost-intensive.

The problem of the invention is to provide a device and a process of the aforementioned type for breaking away blank cuttings, obviating the time-consuming, manual setting of the clamping pins on the lower slide-in frame in accordance with the particular blank type and aligned with the breaking away shafts and makes available a universally usable breaking away and clamping tool usable for all or a maximum number of blank types and which simultaneously ensures a reliable discharge of the broken away cuttings.

In the case of a breaking away device for blank cuttings according to the preamble of claim 1, according to the invention this problem is solved in that the clamping tool is constructed as a flat element, the surface engages over the openings of the matrix and can be pressed onto the latter and can be operatively connected with the breaking away tools over the cuttings for the breaking away thereof.

As a result of the flat construction, namely extending over and beyond the contours of the openings, of the clamping tool performing a counterholding function for the cuttings to be broken away, the matrix is contacted in full-surface manner from below and can therefore be given a limited thickness. Due to the resulting limited depth of the matrix opening, even in the case of a flat construction of the clamping tool it is possible to achieve an elastic clamping connection between the breaking away shaft, the cutting and the clamping face of the clamping tool, leading to a flat contact between the cutting and the clamping tool for the reliable gripping of the cutting or as a result of the extremely small distance between the breaking away shaft and the flat element a sliding of the breaking away shaft on the cutting is prevented and a clamping connection is obtained.

The invention also includes a construction in which the matrix is as thin as e.g. a foil and is supported by a flat element without an elastic surface. In this case there is a clamping of the cutting even after an extremely short travel of the breaking away shafts following the engagement thereof on the cutting, because said short travel roughly corresponds to the thickness of the extremely thin matrix.

The elastic operative connection between the clamping tool constructed as a flat element and the breaking away shafts is brought about in simple manner according to a further development of the invention in that the clamping tool is formed by a flat, elastic covering layer with a smooth surface placed on a fixed, planar substrate. According to a development of the invention the elastic covering layer is formed by a foam material, which is compressed on pressing the clamping tool in the form of a planar surface onto the matrix and curves into the matrix openings and consequently brings about the clamping holding of the cutting between the breaking away shaft and the flat clamping tool and this is also maintained during the downward movement of the breaking away and clamping tool and consequently the reliable holding and breaking away of the cutting are ensured.

The removal of the separated cuttings takes place with a one-piece construction of the clamping tool constructed as a flat element by scraping or blowing off devices. The clamping tool can be constructed as a belt conveyor with an elastic covering layer, which can be raised and lowered cyclically and synchronously with the breaking away tools, and with a conveying direction at right angles to the device transporting direction. Alternatively, air nozzles can be so arranged and cyclically subject to the compressed air that they blow off the broken away cuttings.

According to a further development of the invention the clamping tool, in the case of a multipart construction, comprises rotary clamping segments for the cyclic formation of openings in the clamping surface, so as to bring about the ejection and discharge of the broken away cuttings.

The clamping segments are preferably components with the cross-section of an equilateral triangle, which in the starting position on the matrix form a planar, cohesive clamping surface and during the down stroke openings and rotatable with the cycle of the upward and downward movement of the slide-in frame for the clamping tool about the longitudinal axis thereof by preferably 90°, the outer faces being covered with the elastic covering layer. Thus, in each cutting or breaking away stroke a different clamping face is available for the clamping process, whilst during the clamping face change caused by the clamping segment rotation, the separated cuttings drop from the preceding clamping face and pass through the openings formed between the clamping segments into a waste container.

According to the invention, alternatively the clamping tool is formed by plate-like clamping segments rotatable about its longitudinal axis with an elastic covering layer provided on both sides, the plate-like clamping segments being rotated by at least 90° during the up/down stroke for the formation of openings between the clamping segments and for ejecting the cuttings following a breaking away cycle.

Preferably the plate-like clamping segment is provided on one side with the elastic covering layer and in the working cycle for forming ejection openings it is tilted during the down stroke by a particular angle of at least 90° and during the following up stroke is tilted back into the starting position, so as to remove the separated cuttings from the clamping face.

For producing the cyclic rotary movement of the clamping segments to the receiving frame of the device are fitted drive motors, which are in operative connection with the spindles of the clamping segments for the rotary drive and are controlled synchronously with the drive system of the automatic cutting press. The drive motors are also so controlled that the clamping segments during the down stroke and up stroke are driven in the same rotation direction, unless use is made of reciprocatable, plate-like clamping segments. For the latter case, for one plate-like clamping segment, which only performs one tilting movement and then tilts back into the starting position, there is a single drive bringing about the reciprocating movement of said clamping segment.

Alternatively and whilst obviating the elastic covering layer, the clamping tool is constructed as an all elastic or elastically mounted, one or multiple part, flat element, or the cutting away shafts are elastically mounted and the one or multiple part, flat element is not elastically constructed, as indicated hereinbefore.

The present invention leads to a universal tool for different blank types and arrangements for the purpose of breaking away blanks of different shape, size and arrangement and which can be used without difficulty in conventional breaking away stations and allows a simple reequipping of existing installations (cf. claim 19).

It obviates the manually performed setting of the lower clamping pins in precise positions with respect to the upper cutting away shafts, which is necessary for each individual blank type in the hitherto known breaking away tools and which is very time consuming and also requires skill and experience. There is also no need for a cost-intensive storage with high space demands for the frames to be equipped with the lower clamping pins or already provided with the clamping pins for different blank types. The function of the inventively proposed tool is simple and reliable, because the flat construction of the clamping tool is appropriate for each shape of cutting to be broken away or the matrix opening and also permits the gripping of very narrow blanks by the clamping tool. The cyclic opening of the clamping face with a multipart clamping tool formed from clamping segments ensures a reliable ejection of the waste separated from the cardboard blanks without additional aids and can also be implemented on the drive side with simple drives having a synchronization with the lifting movement or stroke, e.g. of a conventional slide-in frame for the clamping pins.

Further developments of the invention can be gathered from the subclaims.

The invention also covers a clamping tool according to claims 20 and 21, as well as a process according to claims 22 and 23.

An embodiment of the invention is described in greater detail hereinafter relative to the drawings, wherein show:

FIG. 1 A perspective view of a breaking away station of an automatic cutting press with a receiving frame-for the breaking away tool, matrix and a clamping tool.

FIGS. 2 to 5 A diagrammatic representation of the breaking or cutting away process using a flat clamping tool.

The breaking away station of an automatic cutting press for cardboard blanks essentially comprises the three superimposed receiving frames 1, 2 and 3 for the breaking away tools, matrix 11 and clamping tools, also in slide-in frame form for reequipping purposes.

The receiving frame 1 contains a receiving plate 4, in which there are bores 8 corresponding to the shape size and arrangement of the cutting 6 to be broken out of the cardboard blank 7 and in which are fixed the breaking away shafts 9, which form the breaking away tool. To the underside of the receiving plate 4 are also fitted elastic, block-like blank holders 10 for the cardboard blanks 7.

A further receiving frame 2 with lateral holding rails 15 is used for receiving the matrix 11, in which there are matrix openings 12 identical as regards shape and arrangement to the cutting 6 between the cardboard blanks 7 and which are slightly larger than the cutting 6. The cardboard sheet 5 cut out in the cuttings device is held together by small cardboard bridges 13 left behind between the cutting 6 and the cardboard blanks 7, so that the cardboard sheet 5 can be completely removed from the cutting mechanism by means of grippers and problems due to loose cuttings 6 in the cutting out area are prevented. The broken line 14 in FIG. 1 indicates the cut out cardboard sheet 5, which prior to the breaking away of the cuttings 6 is in its correct position on the matrix 11 and is substantially identical thereto in plan view.

The clamping tool is received by a further receiving frame 3. The clamping tool is constructed as a multipart, flat element 16, which comprises cross-sectionally triangular clamping segments **16*a* mounted in rotary manner on the end faces of the receiving frame 3, the circumferential surfaces of the clamping segments 16*a* form fixed, planar substrates 17*b* and are covered with an elastic covering layer 17**, which represents the actual clamping element.

The drive of the rotatable clamping segments **16*a* is brought about synchronously with the cyclic up and down movement of the receiving frame 3 by means of a not shown gear located on the frame 3 and provided with a drive motor. Thus, there is a cyclic and preferably sequence-modulatable rotary movement of the clamping segments 16*a*** by a given angle.

The function of the represented breaking away device for blanks will now be described. Corresponding to the shape, size and arrangement of the cardboard blanks 7 to be produced with the intermediately located cuttings 6, the bores 8 are inserted in the receiving plate 4 and the matrix openings 12 in the matrix 11 in automatic manner in accordance with a predetermined program and the breaking away shafts 9 are placed in the bores 8 and the blank holder 10 is fitted to the receiving plate 4. After the receiving plate 4 has been inserted in the receiving frame 1 and the matrix 11 in the holding rails 15 of the receiving frame 2, the thus prepared receiving frames 1, 2 are slid into the breaking away station of the automatic cutting press.

For the housing of the clamping tool use is made in preferred manner of a slide-in frame normally used in breaking away stations for fixing the clamping pins serving as counterholders for the cutting. Thus, it is possible to reequip the breaking away stations of conventional automatic cutting presses in simple manner with the novel clamping tools or to optionally insert differently constructed clamping tools or optionally the frames with the conventional clamping pins.

Figure 3:
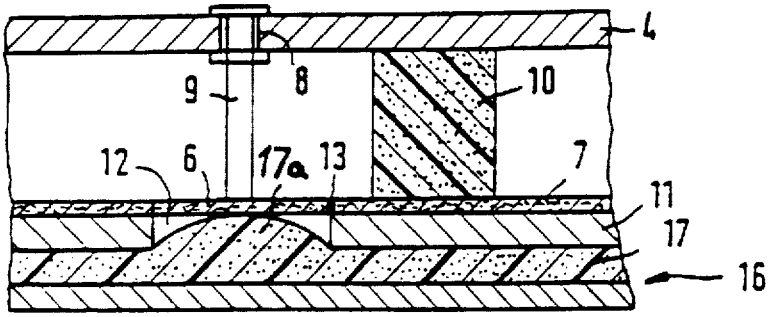
Figure 4:
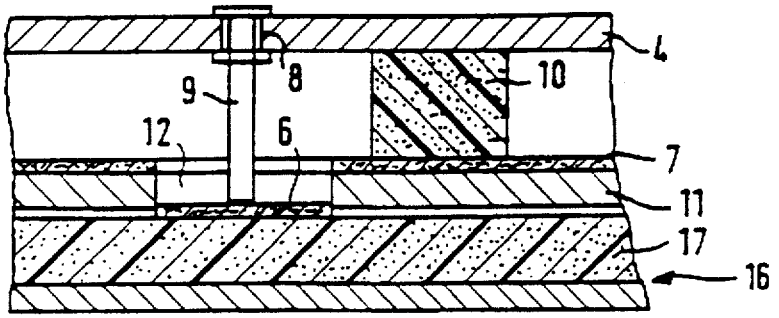
Figure 5:
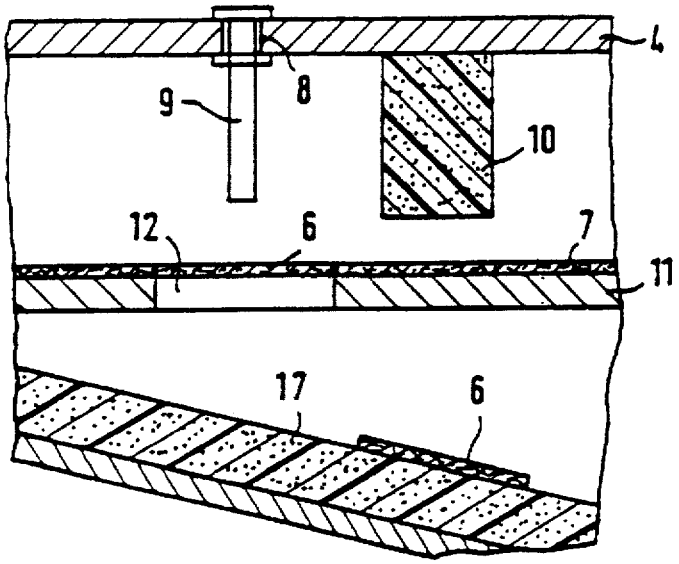

The functional action of the clamping tool constructed as a flat element with an elastic covering layer 17 in conjunction with the breaking away shaft 9 will be described hereinafter relative to FIGS. 2 to 5, FIG. 2 showing the position prior to breaking away, FIG. 3 the position at the start of the breaking away process, FIG. 4 the position after breaking away and FIG. 5 the position of the downwardly tilting clamping segment for removing the waste and new cardboard sheeting placed on the matrix 11.

The cut out cardboard sheet 5 placed by means of not shown grippers on the matrix 11 is held after the downward movement of the receiving frame 1 by blank holder 10 on the matrix 11. Simultaneously the flat element 16 with the clamping segments **16*a* presses with its entire surface from below against the matrix 11. Thus, the matrix 11 is supported from below and can be given a comparatively small thickness, because during the breaking away process it only has to absorb limited forces. The small thickness of the matrix and the elastic construction of the surface of the clamping segments 16*a* also mean that the elastic, foam covering layer 17 curves into the matrix opening 12 and this outward curve 17*a*, as shown in FIG. 3, is elastically pressed against the underside of the cutting 6 and consequently jams the cutting 6 between the curve 17*a* and the breaking away shaft 9. In the following breaking away process during the downward movement of the breaking away shaft 9 and the clamping tool 16, the cutting 6 is downwardly supported flat and entrained until the tearing away takes place of the cardboard bridge 13 between the cardboard blank 7 and the cutting 6 and the following ejection from the matrix opening 12, so that a sliding of the breaking away shaft 9 on the cutting 6** is avoided and a reliable breaking away is ensured.

There is no elastic curving in of the elastic, foam covering layer 17 if the matrix 11 is made extremely thin and the flat element 16 is not elastic (not shown), so that the underside of the cutting 6 contacts or almost contacts the flat element 16 during the engagement of the cardboard sheet 5 and at the latest following the placing of the breaking away shaft 9 on the top of the cuttings 6.

Whilst the receiving frame 1 with the breaking away tool then moves upwards and a new cut out or punched cardboard sheet 5 is placed on the matrix 11, the down stroke of the receiving frame 3 is continued in order to bring about a further function of the clamping tools constructed as a flat element 16, namely the ejection process for the separated cutting 6. During the downward movement of the receiving frame 3 the not shown gear gives the clamping segments **16*a* a rotary movement of at least, 60° and preferably 90°. The clamping faces of the clamping segments 16*a* pass into an inclined position (FIG. 5) and in the case of a 90° rotation subsequently into a not shown, vertical position, so that the cutting 6 reliably slides from the clamping face and as a result of the openings cyclically formed between the clamping segments 16*a* during the rotation thereof, passes into a not shown waste container below the receiving frame 3. At the end of the down stroke the triangular clamping segments 16*a* assume the position shown in dot-dash line form in FIG. 1** with a vertical (60° rotation) or inclined (not shown, 90° rotation), upwardly directed apex.

During the following upward movement of the receiving frame 3, the rotary movement of the clamping segments **16*a* is continued by a further angle of 60° with a 60° rotation during the down stroke and 30° with a 90° rotation during the down stroke. Thus, during the up stroke the cutting can drop from the clamping face of the clamping segment 16*a*** if, in exceptional cases, it has not dropped off during the down stroke.

No matter how the rotation angles of the clamping segments **16*a*** and their modulatable rotary speed are chosen, at the end of the up stroke there is always a new, closed, elastic surface for engaging the cuttings and for the next breaking out process.

In order to ensure after each up stroke of the slide-in frame 3 a precisely horizontal position of the particular clamping faces of the clamping segments 16*a*, a slowing-down brake is appropriately integrated into the drive system.

I claim:

1. Device for breaking away blank cuttings during the cutting out of cardboard in an automatic cutting press, comprising:

a matrix adapted to underlie the cardboard, said matrix having openings which are slightly larger than the cuttings to be broken away, cyclically vertically movable breaking away tools disposed vertically above the matrix, cyclically vertically movable clamping tools for gripping and separating the cuttings in conjunction with the breaking away tools, the clamping tools being disposed vertically below the matrix (11), characterized in that the clamping tool is constructed as a flat element (16) with a surface which spans over said openings (12) of the matrix (11), which can be pressed onto said matrix (11), and which is bringable into an operative conjunction with the breaking away tools over the cuttings (6) for breaking away the latter, wherein the element (16) has a multipart construction which comprises a plurality of rotary clamping segments (16*a*) that form a cohesive, planar surface on the matrix (11) in a starting position, and that form openings in the clamping face between the clamping segments (16*a*) when spaced from the matrix (11) for ejecting the cuttings (6) from the device.

2. Device according to claim 1, characterized in that the element (16) has a flat, elastic covering layer (7).

3. Device according to claim 2, characterized in that the flat, elastic covering layer (17) is made from foam with a smooth surface.

4. Device according to claim 2, characterized in that the elastic covering layer (17) for supporting the cuttings (6) and pressing on the matrix (11) curves in with outwardly directed curves (17*a*) into the openings (12) of the matrix (11) until engagement takes place with the lower face of the cuttings (6) for clamping, entraining and breaking out the cuttings (6) clamped between the breaking away tools and the outwardly directed curves (17*a*).

5. Device for breaking away blank cuttings during the cutting out of cardboard in an automatic cutting press, comprising:

a matrix adapted to underlie the cardboard, said matrix having openings which are slightly larger than the cuttings to be broken away, cyclically vertically movable breaking away tools disposed vertically above the matrix, cyclically vertically movable clamping tools for gripping and separating the cuttings in conjunction with the breaking away tools, the clamping tools being disposed vertically below the matrix (11), characterized in that the clamping tool is constructed as a flat element (16) with a surface which spans over said openings (12) of the matrix (11), which can be pressed onto said matrix (11), and which is bringable into an operative conjunction with the breaking away tools over the cuttings (6) for breaking away the latter, and the clamping tool forming a planar clamping and supporting face comprises a plurality of clamping segments (16*a*) provided on all sides with an elastic covering layer (17), each clamping segment having cross-sectionally the shape of an equilateral triangle and being rotatable about its longitudinal axis upon downward movement of a receiving frame (3) supporting the clamping segments, said clamping segments being rotated to an angle of at least about 60°.

6. Device for breaking away blank cuttings during the cutting out of cardboard in an automatic cutting press, comprising:

a matrix adapted to underlie the cardboard, said matrix having openings which are slightly larger than the cuttings to be broken away, cyclically vertically movable breaking away tools disposed vertically above the matrix, cyclically vertically movable clamping tools for gripping and separating the cuttings in conjunction with the breaking away tools, the clamping tools being disposed vertically below the matrix (11), characterized in that the clamping tool is constructed as a flat element (16) with a surface which spans over said openings (12) of the matrix (11) which can be pressed onto said matrix (11), and which is bringable into an operative conjunction with the breaking away tools over the cuttings (6) for breaking away the latter, and the clamping tool is formed of a plurality of plate-like clamping segments each rotatable about its longitudinal axis upon upward and downward movement of a receiving frame (3) supporting the clamping segments, said clamping elements closely engaging each other to form a continuous clamping face in a starting position.

7. Device according to claim 6, characterized in that the plate-like clamping segments are covered on all sides with a elastic covering layer and in a working cycle are in each case rotatable by 180°, namely by in each case 90° during the down stroke and the up stroke.

8. Device according to claim 6, characterized in that the plate-like clamping segments are covered on one side with a elastic covering layer and in each working cycle can be tilted backwards and forwards by a given angle $\alpha$.

9. Device according to claim 8, characterized in that the angle $\alpha$ is at least 90°.

10. Device according to claim 6, characterized in that the rotary clamping segments on the receiving frame (3) for the clamping tool is provided with a motor driven gear controlled synchronously with a drive system of the automatic cutting press for the down or up stroke of the receiving frame (3) and connected with the rotary mounted clamping segments for the driving thereof.

11. Device according to claim 8, characterized in that for producing the tilting movement of the plate-like clamping segments provided on one side with the elastic covering layer a drive bringing about a reciprocating tilting movement in the machine cycle is provided.

12. Device according to claim 1, characterized in that the flat element, is at least one of completely elastic and elastically mounted, and of at least one part, with a fixed, non-elastic surface.

13. Device according to claim 1, characterized in that the flat element has a non-elastic surface, and the breaking away tools constructed as breaking away shafts are elastically mounted in the breaking away direction.

14. Device according to claim 1, characterized in that the matrix (11), the breaking away tool and the clamping tool are in each case located in a slide-in frame (1, 2, 3).

* * * * *